US008973850B2

(12) United States Patent
Perinet et al.

(10) Patent No.: US 8,973,850 B2
(45) Date of Patent: Mar. 10, 2015

(54) ROTARY SPRAY DEVICE AND METHOD OF SPRAYING COATING PRODUCT USING SUCH A ROTARY SPRAY DEVICE

(75) Inventors: Sylvain Perinet, Chemin des Scies (FR); Franck Gerstch, Meylan (FR)

(73) Assignee: Sames Technologies, Meylan (FR)

( * ) Notice: Subject to any disclaimer, the term of this patent is extended or adjusted under 35 U.S.C. 154(b) by 964 days.

(21) Appl. No.: 13/121,926

(22) PCT Filed: Sep. 30, 2009

(86) PCT No.: PCT/FR2009/051859
§ 371 (c)(1),
(2), (4) Date: May 17, 2011

(87) PCT Pub. No.: WO2010/037972
PCT Pub. Date: Apr. 8, 2010

(65) Prior Publication Data

US 2011/0210180 A1 Sep. 1, 2011

(30) Foreign Application Priority Data

Sep. 30, 2008 (FR) ..... 08 56607

(51) Int. Cl.
*B05B 3/10* (2006.01)
*B05B 1/28* (2006.01)
*B05B 5/04* (2006.01)

(52) U.S. Cl.
CPC ..... *B05B 3/1092* (2013.01); *B05B 3/1014* (2013.01); *B05B 5/0407* (2013.01); *B05B 5/0426* (2013.01); *Y10S 239/14* (2013.01)
USPC ..... 239/296; 239/223; 239/DIG. 14

(58) Field of Classification Search
USPC ..... 239/7, 222.11, 223, 224, 246, 248, 290, 239/294, 296–298, 418, 423, 424, 424.5, 239/700, 701, 703, DIG. 14
See application file for complete search history.

(56) References Cited

U.S. PATENT DOCUMENTS

| | | | | |
|---|---|---|---|---|
| 5,685,495 | A | 11/1997 | Pham et al. | |
| 6,050,499 | A * | 4/2000 | Takayama et al. | 239/112 |
| 2004/0129799 | A1 * | 7/2004 | Krumma et al. | 239/290 |
| 2004/0144860 | A1 | 7/2004 | Nolte et al. | |
| 2005/0045735 | A1 * | 3/2005 | Seitz | 239/7 |
| 2006/0219816 | A1 * | 10/2006 | Herre et al. | 239/451 |
| 2007/0034715 | A1 * | 2/2007 | Clifford et al. | 239/291 |
| 2007/0063068 | A1 * | 3/2007 | Seitz et al. | 239/223 |
| 2011/0000974 | A1 * | 1/2011 | Nolte et al. | 239/3 |

FOREIGN PATENT DOCUMENTS

| | | |
|---|---|---|
| EP | 2 058 053 | 5/2009 |
| JP | 08 084941 | 4/1996 |

(Continued)

*Primary Examiner* — Darren W Gorman
(74) *Attorney, Agent, or Firm* — Berenato & White, LLC

(57) ABSTRACT

A rotary device for spraying a coating product is provided. The rotary device includes a spray member having an edge and able to form a jet of coating product, a device for driving the rotation of the spray member and a body which is fixed. The body that is fixed includes primary orifices arranged on a primary outline surrounding the axis of rotation and intended to eject a primary air jet in a primary direction and secondary orifices arranged on a secondary outline surrounding the axis of rotation and intended to eject a secondary air jet in a secondary direction. The respective orientations and positions of each primary direction and of each secondary direction cause combined jets to be formed, each resulting from the intersection between a primary air jet and a secondary air jet that are associated with one another, the region of intersection lying upstream of the edge.

26 Claims, 4 Drawing Sheets

(56) References Cited

FOREIGN PATENT DOCUMENTS

| | | | | | |
|---|---|---|---|---|---|
| JP | 08 131902 | | 5/1996 | | |
| WO | WO 2005/115636 | | 12/2005 | | |
| WO | WO 2008068005 | A1 * | 6/2008 | ..... | B05B 3/10 |
| WO | WO 2008/095657 | | 8/2008 | | |
| WO | WO 2009/010646 | | 1/2009 | | |
| WO | WO 2009112932 | A1 * | 9/2009 | ..... | B05B 5/04 |

* cited by examiner

ROTARY SPRAY DEVICE AND METHOD OF SPRAYING COATING PRODUCT USING SUCH A ROTARY SPRAY DEVICE

CROSS-REFERENCE TO RELATED APPLICATIONS

Cross-Reference to Related Applications and claim to Priority This application relates to International Application No. PCT/FR2009/051859 filed Sep. 30, 2009 and French Patent Application No. 08 56607 filed Sep. 30, 2008, of which the disclosures are incorporated herein by reference and to which priority is claimed.

BACKGROUND OF THE INVENTION

1. Field of the Invention

The present invention relates to a rotary spray device for coating product. The present invention also relates to a method of spraying coating product using such a rotary spray device.

2. Description of Related Art

Conventional spraying, using rotary spray devices, is used for applying a primer, a base coat and/or a lacquer to objects that are to be coated, such as motor vehicle bodywork. A rotary spray device for spraying coating product comprises a spray member rotating at high speed under the effect of rotational-drive means, such as a compressed air turbine.

Such a spray member generally has the shape of a cup with symmetry of revolution and comprises at least one spray edge able to form a jet of coating product. The rotary spray device also comprises a fixed body housing the rotational-drive means and means of supplying the spray member with coating product.

The jet of coating product sprayed by the edge of the rotary member has a roughly conical shape dependent on parameters such as the rotational speed of the cup and the flow rate of coating product. To control the shape of this jet of product, rotary spray devices of the prior art are generally equipped with several primary orifices formed in the body of the spray device and arranged in a circle which is centered on the axis of symmetry of the cup and which is situated on the exterior periphery of the cup. The primary orifices are intended to emit jets of primary air which together form the air that shapes the jet of product, this shaping air sometimes being known as the "shroud air".

JP-A-8 071 455 describes a rotary spray device equipped with primary orifices intended to emit jets of primary air in order to shape the jet of product. Each jet of primary air is inclined with respect to the axis of rotation of the cup in a primary direction that has an axial component and an orthoradial or circumferential component. The jets of primary air thus generate a swirling air flow around the exterior periphery of the cup and of the jet of coating product. This swirling air flow, sometimes termed a "vortex", can be used, notably if its flow rate is adjusted, to shape the jet of product sprayed by the edge to suit the desired application.

The body of the rotary spray device illustrated in FIG. 6 of JP-A-8 071 455 is also provided with several secondary orifices likewise arranged on the exterior periphery of the cup and on the same circle as the primary orifices and offset therefrom. Each jet of secondary air emanating from one of these secondary orifices is inclined with respect to the axis of rotation in a secondary direction that has an axial component and a radial component. These components are determined in such a way as to inject air flows around the cup to reduce the depression caused downstream of the cup by the high-speed rotation of the cup.

Thus, the jets of secondary air are intended to yield a uniform film of applied paint. To this end, it is necessary for the jets of secondary air to arrive directly in the depression zone situated facing the cup and downstream thereof. The direction of each jet of secondary air is therefore determined such that any impingement of the jet of secondary air with the rear surface of the cup is avoided.

However, such flows of secondary air require fine adjustment in order to avoid deterioration of the shape of the jet of coating product. In addition, jets of secondary air inclined in this way cannot be used to adjust either the shape of the jet of product or, as a result, the area of impact of the sprayed droplets on the object being coated.

Furthermore, such a rotary spray device induces relatively high shroud air and vortex air speeds, and this carries the risk of qualitatively and quantitatively degrading the application of coating product to the object being coated.

Qualitatively on the one hand, an object coated using such a rotary spray device exhibits impacts the profiles of which are sometimes uneven and generally not very robust. The robustness of an impact of a coating product from a rotary spray device corresponds substantially to the evenness of a curve depicting, as a function of a set parameter such as the shroud air flow rate, the median or upper deposited thickness zone width considered in a direction perpendicular to the direction of relative movement between the rotary spray device and the object being coated.

Quantitatively on the other hand, the deposition efficiency of such a rotary spray device is relatively limited. Deposition efficiency, also known as transfer efficiency, is the ratio of the amount of coating product deposited on the object being coated to the amount of coating product sprayed using the rotary spray device.

JP-A-8 084 941 describes a rotary spray device equipped with primary orifices and with secondary orifices for respectively emitting jets of primary air and jets of secondary air. The jets of primary air and the jets of secondary air are oriented in respective directions that are parallel or divergent, leading to marginal and low-volume intersections between adjacent jets. Such a rotary spray device therefore also has the abovementioned disadvantages.

BRIEF SUMMARY OF THE INVENTION

The present invention aims notably to address these disadvantages by proposing a coating product rotary spray device that makes it possible to obtain relatively high deposition efficiencies and good robustness of the impacts between the coating product and the objects being coated.

To this end, one subject of the invention is a rotary spray device for coating product, comprising:

- a coating product spray member having at least one roughly circular edge and able to form a jet of coating product,
- means for driving the rotation of the spray member, and
- a body which is fixed and which comprises:
  - primary orifices arranged on a primary contour surrounding the axis of rotation of the spray member, each primary orifice being intended to eject a jet of primary air in a primary direction,
  - secondary orifices arranged on a secondary contour surrounding the axis of rotation of the spray member, each secondary orifice being intended to eject a jet of secondary air in a secondary direction.

The respective orientations of each primary direction and of each secondary direction and the respective positions of each primary orifice and of each secondary orifice cause the formation of combined jets each resulting from the intersection of at least one jet of primary air and at least one jet of secondary air which are associated with one another, the region of intersection lying upstream of the edge.

According to other advantageous but optional features of the invention, considered in isolation or in any technically permissible combination:

- each primary direction and the spray member are separate and in that each secondary direction is secant to the spray member;
- each secondary direction extends in a plane containing the axis of rotation, and the secondary directions roughly converge toward a vertex lying on the axis of rotation;
- each primary orifice and the associated secondary orifice are separated by a distance of between 0° mm and 10° mm, preferably equal to 1 mm;
- the primary orifices and the secondary orifices are respectively positioned on the primary contour and on the secondary contour so as to cause two adjacent combined jets to mix partially;
- all of the primary directions and all of the secondary directions respectively display symmetry with respect to the axis of rotation;
- the distance between the primary contour and the edge, considered along the axis of rotation, is between 5 mm and 30 mm, and in that the distance between the secondary contour and the edge, considered along the axis of rotation, is between 5 mm and 30 mm;
- the primary contour and the secondary contour are each of circular shape;
- the primary contour and the secondary contour are located in a common plane, the common plane being perpendicular to the axis of rotation;
- the primary contour and the secondary contour are located on a roughly frustoconical surface which extends in the downstream part of the fixed body and around the axis of rotation of the cup;
- the primary contour and the secondary contour coincide in a circle centered on the axis of rotation, the ratio between the diameter of the edge and the diameter of the circle being between 0.65 and 1 and preferably being equal to 0.95;
- the body comprises between 20 and 60 primary orifices and between 20 and 60 secondary orifices; the primary orifices and the secondary orifices are circular; the primary orifices are arranged on the circle such that they alternate with the secondary orifices, and the diameter of the primary orifices and the diameter of the secondary orifices range between 0.4 mm and 1.2 mm and are preferably both equal to 0.8 mm;
- a primary direction and an associated secondary direction meet at a meeting point, the distance along the axis of rotation between the common plane and the meeting point ranging between 0.5 times and 30 times, preferably between once and twice, the longest dimension of the primary or secondary (6) orifices considered in the common plane;
- each combined jet has a cross section in the plane of the edge which is roughly in the shape of an ellipse truncated by the edge, the major axis of the ellipse being inclined with respect to a direction locally tangential to the edge by an angle of between 20° and 70° and preferably of between 35° and 55°; and
- the primary directions pass at a radial distance of between 0 mm and 25 mm and preferably of 0 mm from the edge, and the secondary directions intersect the spray member at an axial distance of between 0 mm and 25 mm and preferably of 3.5 mm from the edge.

Moreover, another subject of the present invention is a method of spraying a coating product, implementing a rotary spray device as set out hereinabove, with a total air flow rate of between 100 Nl/min and 1000 Nl/min, preferably between 300 Nl/min and 800 Nl/min and containing from 25% to 75%, preferably 33%, of flow rate from the jets of primary air and 75% to 25%, preferably 67%, of flow rate from the jets of secondary air.

Furthermore, a further subject of the invention is an installation for spraying coating product which comprises at least one rotary spray device as set out hereinabove.

BRIEF DESCRIPTION OF THE DRAWINGS

The invention will be clearly understood and its advantages will also become more apparent from the following description, given solely by way of nonlimiting example and made with reference to the attached drawings in which.

DETAILED DESCRIPTION OF THE INVENTION

Figure 1:
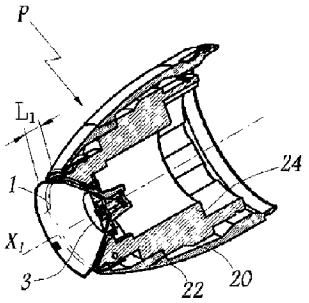
FIG. 1 is a perspective view with cutaway of a rotary spray device according to the invention.

FIG. 1 shows a rotary spray device P for spraying coating product comprising a spray member 1, hereinafter termed a cup. The cup 1 is partially housed in a body 2. The cup 1 is depicted in a spraying position in which it is rotationally driven to a high speed about an axis $X_1$ by drive means, not depicted. The axis $X_1$ therefore constitutes the axis of rotation of the cup 1. The body 2 is fixed, that is to say does not rotate about the axis $X_1$. The body 2 may be mounted on a support, not depicted, such as a multi-axis robot arm.

A directional control valve 3 is secured to the upstream part of the cup 1 to channel and distribute the coating product. The rotational speed of the cup 1 under load, that is to say when spraying product, may range between 30 000 rpm and 70 000 rpm.

The cup 1 exhibits symmetry of revolution about the axis $X_1$. The cup 1 has a distribution surface 11 over which the coating product spreads out, under the effect of centrifugal force, until it reaches a spray edge 12 where it is atomized into fine droplets. The collection of droplets forms a jet of product, not depicted, which leaves the cup 1 and heads toward an object to be coated, not depicted, on which it impinges. The external rear surface 13 of the cup 1, that is to say the surface which does not face toward its axis of symmetry $X_1$, faces toward the body 2.

The body 2 has primary orifices 4 and secondary orifices 6. The primary orifices 4 are arranged on a primary contour $C_4$ which surrounds the axis $X_1$. Likewise, the secondary orifices 6 are arranged on a secondary contour $C_6$ which surrounds the axis $X_1$. The primary contour $C_4$ and the secondary contour $C_6$ are arranged in a common plane $P_{46}$. The common plane $P_{46}$ is perpendicular to the axis $X_1$. The plane $P_{46}$ lies in the downstream part of the body 2. Because the body 2 displays symmetry of revolution about the axis $X_1$, the common plane $P_{46}$ is embodied by a flat annulus containing the primary $C_4$ and secondary $C_6$ contours.

The terms "upstream" and "downstream" refer to the direction of flow of the product from the base of the rotary spray device P, situated to the right in FIG. 1, as far as the edge 12, situated to the left in FIG. 1.

In the example of FIGS. 1 to 8, the primary contour $C_4$ and the secondary contour $C_6$ each have a circular shape centered on the axis $X_1$. In addition, the primary contour $C_4$ and the contour $C_6$ coincide in a circle C which is therefore centered on the axis $X_1$ and on which the primary orifices 4 and the secondary orifices 6 are arranged. Thus, the primary orifices 4 and the secondary orifices 6 belong to the body 2.

The edge 12 is roughly in the shape of a circle of diameter $D_{12}$ centered on the axis $X_1$. Notches are created between the distribution surface 11 and the edge 12, some of these being depicted in FIG. 2 with the reference 14, in order to improve the control over the size of the droplets atomized at the edge 12. The edge 12 lies an axial distance $L_1$ from the circle C, and therefore from the primary contour $C_4$ or from the secondary contour ($C_6$), this distance here being 10 mm. In practice, the distance $L_1$ may be between 5 mm and 30 mm. The distance $L_1$ represents the extent to which the cup 1 protrudes beyond the body 2. The adjective "axial" qualifies a distance or, more generally, an entity, running in the direction of the axis $X_1$.

The diameter D of the circle C here measures 52.6 mm for a cup 1 of a diameter equal to 50 mm. In practice, the diameter D may be between 50 mm and 77 mm for such a cup. The ratio between the diameter $D_{12}$ of the edge 12 and the diameter D of the circle C is equal to 0.95. In practice, this ratio may be between 0.65 and 1.

Figure 8:
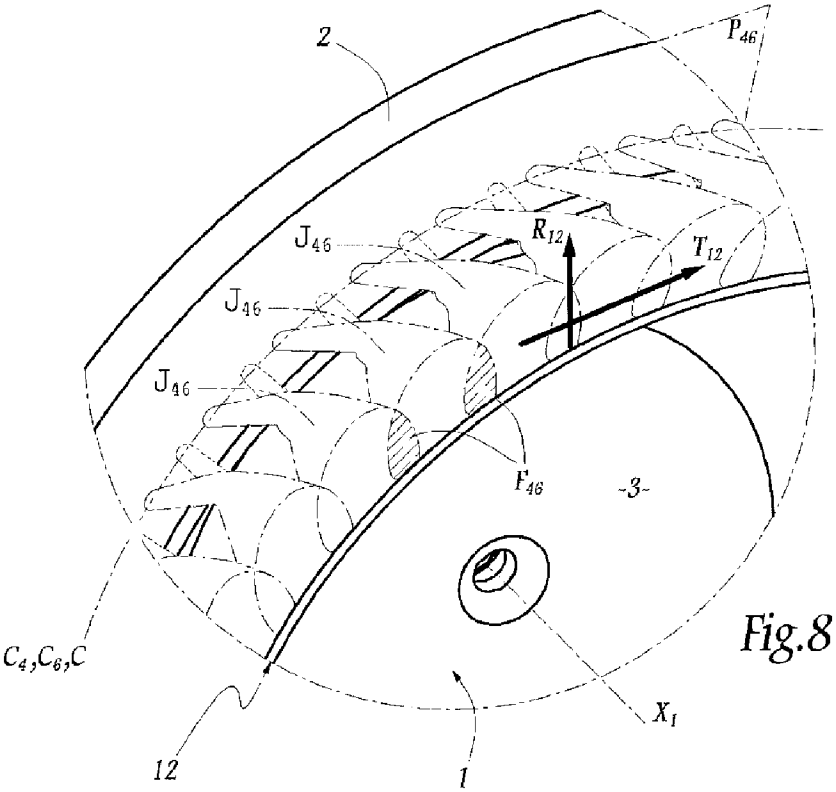
FIG. 8 is a view of detail VIII in FIG. 7.

The primary orifices 4 and the secondary orifices 6 are intended respectively to emit primary air jets $J_4$ and secondary air jets $J_6$ which are depicted in FIGS. 1 and 8 in terms of their respective directions, $X_4$ for the primary and $X_6$ for the secondary. A "primary direction" denotes the direction in which a primary jet $J_4$ is ejected. A "secondary direction" denotes the direction in which a jet of secondary air $J_6$ is ejected.

As FIGS. 2 to 5 show, each jet of primary air $J_4$ is inclined to the axis $X_1$ in a primary direction $X_4$. Each primary direction $X_4$ extends obliquely with respect to the axis $X_1$ and with respect to the common plane $P_{46}$. In other words, each primary direction $X_4$ has non-zero components in the three directions of a Cartesian reference frame the origin of which coincides with the corresponding primary orifice 4, namely the direction of the axis $X_1$, a radial direction and an orthoradial, that is to say circumferential or tangential, direction. Each primary direction $X_4$ and the cup 1 are separate, which means that each jet of primary air $J_4$ can freely cross the region in which the edge 12 is situated.

In other words, the primary air jets $J_4$ do not strike the external rear surface 13 of the cup 1. The primary jets $J_4$ together generate a swirling air flow known as the "vortex air" which is able to influence the shape of the jet of coating product. Each primary direction $X_4$ is such that the corresponding jet of primary air $J_4$ flows at a radial distance $r_4$ from the edge 12 which measures 5 mm. In practice, the distance $r_4$ is non-zero and smaller than 25 mm. The distance $r_4$ is notably dependent on the axial distance $L_1$.

Each jet of secondary air $J_6$ is inclined with respect to the axis $X_1$ in a secondary direction $X_6$ which extends obliquely with respect to the axis $X_1$. Each secondary direction $X_6$ is such that the corresponding jet of secondary air $J_6$ strikes the external rear surface 13 of the cup 1, as can be seen from FIG. 2. Thus, each secondary direction $X_6$ is secant to the surface defining the cup 1 and "intersects" the cup 1 at an axial distance $L_{136}$ from the edge 12 which measures 3.5 mm. In practice, the distance $L_{136}$ may be between 0 mm and 25 mm.

In addition, each secondary direction $X_6$ extends in a plane containing the axis $X_1$ (the meridian plane). The secondary directions $X_6$ converge toward a vertex $S_6$ which is situated on the axis $X_1$. In other words, the secondary direction $X_6$ is transverse to the axis of rotation $X_1$. Each secondary direction $X_6$ can thus be likened to a generatrix of a cone the vertex $S_6$ of which belongs to the axis $X_1$. In a Cartesian frame of reference centered on a secondary orifice 6 and the axes of which are formed by the axis $X_1$, a radial direction and an orthoradial direction, there is a zero orthoradial component for the secondary direction $X_6$ corresponding to the secondary orifice 6 which forms the origin of this frame of reference.

In practice, the secondary directions $X_6$ might not completely converge but rather exhibit confluence in a narrow region close to the axis $X_1$. In an alternative form that has not been depicted, the secondary directions $X_6$ may be separate, that is to say may exhibit neither confluence nor convergence, just like the primary directions $X_4$ in the example of FIGS. 1 to 8.

Figure 3:
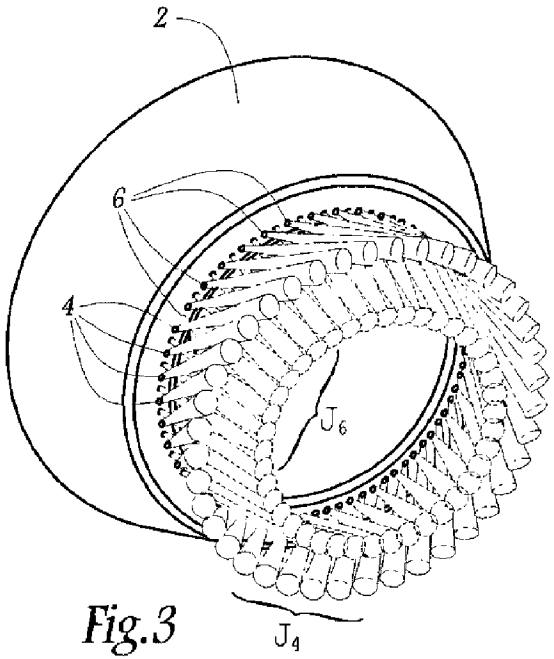
FIG. 3 is a view similar to FIG. 2, but on a smaller scale, notably illustrating one feature of the invention.

As FIG. 3 shows, all of the primary directions $X_4$ of the primary air jets $J_4$ and all of the secondary directions $X_6$ of the jets of air $J_6$ respectively exhibit symmetry with respect to the axis $X_1$. However, other orientations of the primary and secondary directions are possible, particularly asymmetric orientations.

On the circle C, the primary orifices 4 are arranged so that they alternate with the secondary orifices 6. As FIGS. 1 to 8 show, the primary 4 and secondary 6 orifices are uniformly distributed on the circle C, which means that two successive primary orifices 4 or two successive secondary orifices 6 are separated by the same angle B equal to 9° as visible in FIG. 6. In practice, this angle B may be between 6° and 18°.

Figure 6:
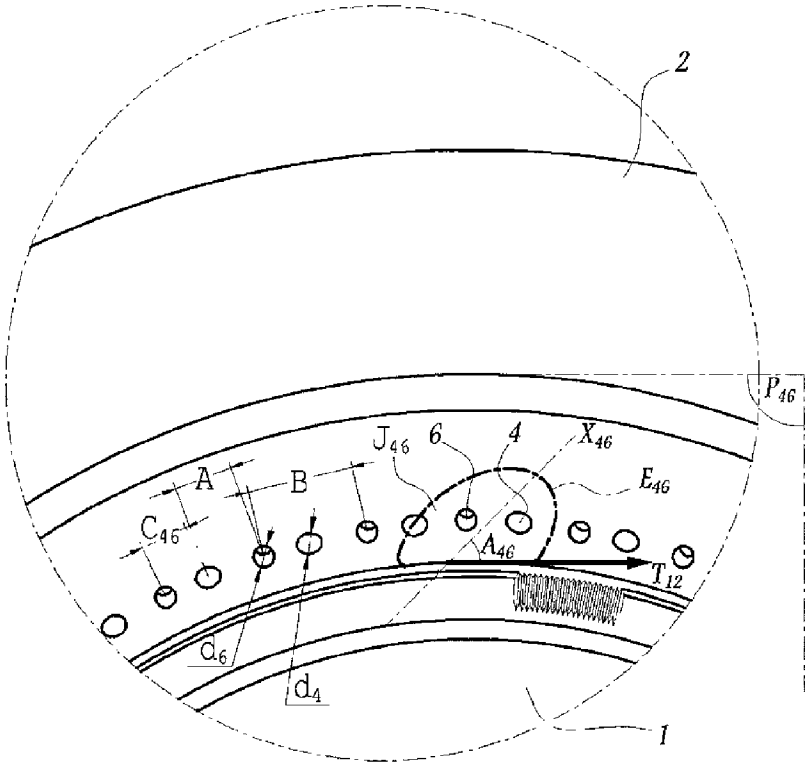
FIG. 6 is a front view on arrow VI of FIG. 5.

In addition, a primary orifice 4 and a secondary orifice 6 which are adjacent to one another are separated by an angle A equal to 6.7°, as visible in FIG. 6, that is to say half the angle B for example separating two successive primary orifices 4. In practice, the angular separation A between a primary orifice 4 and a secondary orifice 6 may be between 3° and 12°.

A primary orifice 4 and an adjacent secondary orifice 6 are separated by a distance $c_{46}$ equal to 1 mm. In practice, the distance $c_{46}$ may be between 0 mm and 10 mm. As described later on, such a distance $c_{46}$ allows the primary $J_4$ and secondary $J_6$ jets to be combined.

The number and distribution of the primary 4 and secondary 6 orifices is determined according to the desired precision for the control of the shape of the jet of product and of the desired uniformity of the impact surface. Thus, the higher the number of orifices 4 and 6, the more even the impact surface. The body 2 comprises approximately forty primary orifices 4 and approximately forty secondary orifices 6. In practice, the body 2 may comprise between twenty and sixty primary orifices 4 and between twenty and sixty secondary orifices 6. As an alternative, primary orifices and secondary orifices in different numbers may be provided.

The primary 4 and secondary 6 orifices have respective diameters $d_4$ and $d_6$, which can be seen in FIG. 6, all equal to 0.8 mm. In practice, the diameters $d_4$ and $d_6$ of the primary 4 and secondary 6 orifices may be between 0.4 mm and 1.2 mm. In particular, the diameters $d_4$ and $d_6$ may differ from one another.

Figure 2:
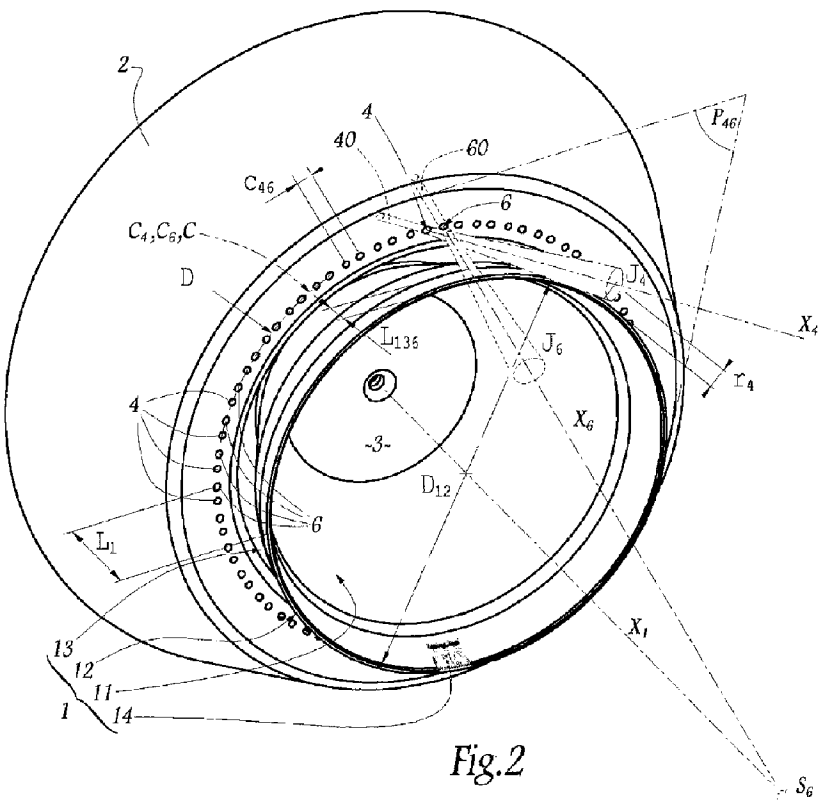
FIG. 2 is a perspective view, on a larger scale, and from a different angle from that of FIG. 1, of part of the spray device of FIG. 1.

Such dimensions make it possible to emit jets of primary air $J_4$ and secondary air jets $J_6$ and flow rates equal respectively to 200 Nl/min (normal liters per minute) and 400 Nl/min when supplied under respective pressures of 6 bar and of 6 bar. As FIGS. 2 and 3 show, each jet of primary air $J_4$ and each jet of secondary air $J_6$ explodes in a cone of relatively small vertex half-angle measuring about 10°.

The primary $J_4$ and secondary $J_6$ directions are determined here respectively by the orientations of primary channels 40 and of secondary channels 60 defined in the body 2. The primary directions $X_4$ and secondary directions $X_6$ correspond to the direction of the respective axes of the primary 40 and secondary 60 channels. In the example of FIGS. 1 to 8, the channels 40 and 60 are straight and open respectively onto the primary 4 and secondary 6 orifices. Upstream, the channels 40 and 60 are connected to two independent compressed air supply sources which are described hereinafter, so as to form the jets $J_4$ and $J_6$.

As FIG. 1 shows, the primary 40 and secondary 60 channels run in a straight line through an external jacket 22 which extends a cap 20 defining the external shroud of the body 2. The channels 40 and 60 are produced using drilling operations at the appropriate angles. The primary channels 40 are connected, upstream, to a primary chamber which is common to them and which is itself connected to a compressed air source, not depicted. Likewise, the secondary channels 60 are connected to a secondary chamber which is common to them and which is connected to a compressed air source, not depicted, and independent of the source that feeds the primary channels 40.

The primary and secondary chambers are formed here between the external jacket 22 and an internal jacket 24, and are separated by an O-ring seal. The adjective "internal" here denotes an object close to the axis of rotation $X_1$, while the adjective "external" denotes an object further away therefrom. The jackets 22 and 24 exhibit symmetry of revolution about the axis $X_1$.

Alternatively, the primary 40 and/or secondary 60 channels may be defined by gaps formed between the external 22 and internal 24 jackets. These gaps may in this case be achieved by machining notches on one and/or the other of the opposing surfaces of the internal 24 and external 22 jackets.

The geometry of the primary 4 and secondary 6 orifices leads to the formation of combined jets $J_{46}$ each of which results from the intersection of a jet of primary air $J_4$ and of a jet of secondary air $J_6$. More specifically, the respective orientations of each primary direction $X_4$ and of each secondary direction $X_6$, particularly with respect to the axis $X_1$, and the respective positions of each primary orifice 4 and of each secondary orifice 6 give rise to, and are therefore determined for the purposes of, the formation of combined jets $J_{46}$, as FIGS. 5 to 8 show.

Figure 5:
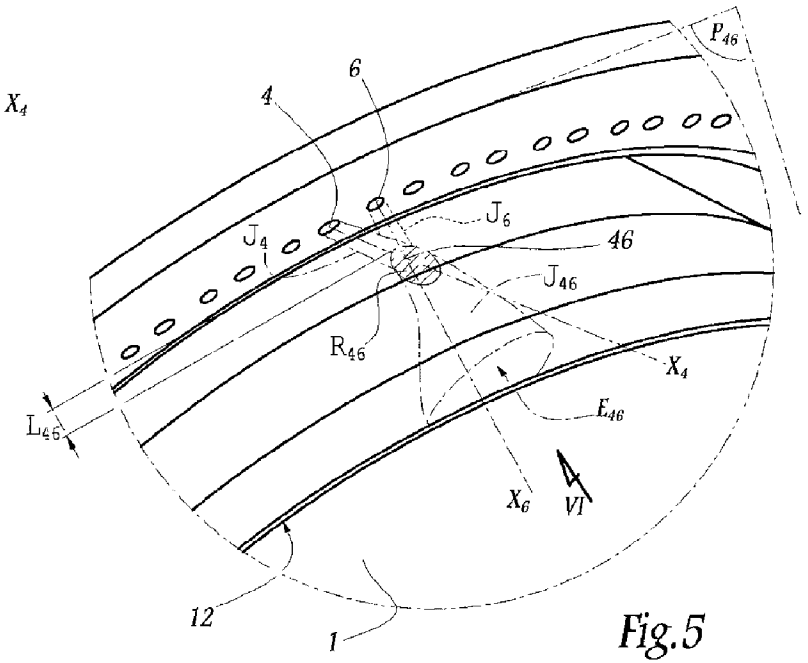
FIG. 5 is a view of detail V in FIG. 4.
Figure 4:
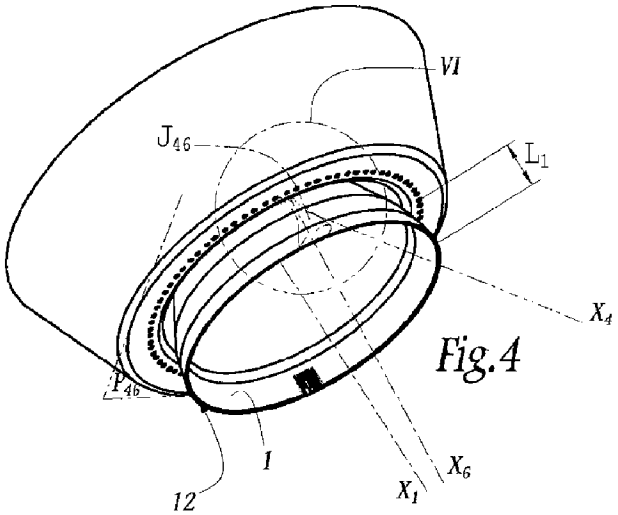
FIG. 4 is a view similar to FIG. 3 notably illustrating one feature of the invention.

Further, for a jet of primary air $J_4$ and an associated jet of secondary air $J_6$, the abovementioned orientations and positions are determined so that their region of intersection $R_{46}$, visible in FIG. 5, lies upstream of the edge 12. The region of intersection $R_{46}$ corresponds to the volume in which a jet of primary air $J_4$ encounters the associated jet of secondary air $J_6$, thus generating a combined jet $J_{46}$.

Figure 7:
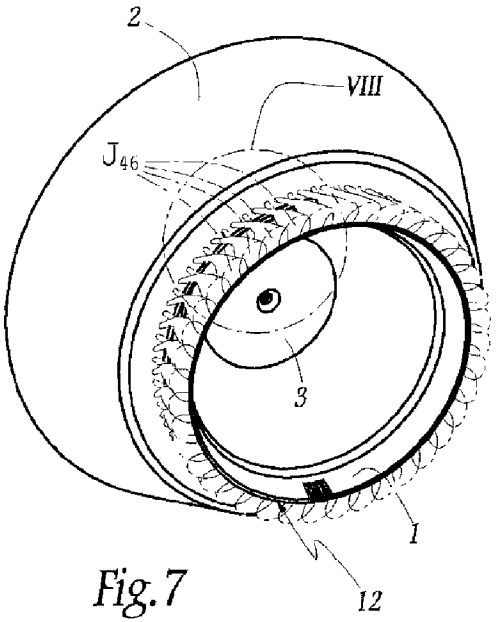
FIG. 7 is a view similar to FIG. 4 and illustrating the operation of the invention.

In other words, a jet of primary air $J_4$ and the associated jet of secondary air $J_6$ deviate and combine with one another into a combined jet $J_{46}$. In the present application, the term "combined" means that a jet of primary air and a jet of secondary air interact and add together significantly. As FIGS. 7 and 8 show, each combined air jet $J_{46}$ is in roughly the shape of a cone widening from the region of intersection $R_{46}$ to downstream of the edge 12.

A primary direction $X_4$ and an associated secondary direction $X_6$ preferably meet at a meeting point 46 belonging to the region of intersection $R_{46}$. Thus, the intersection or interaction between the jet of primary air and the jet of secondary air which correspond to one another is at a maximum. The flow rate of each combined air jet corresponds roughly to the sum of the flow rates of the jet of primary air and of the jet of secondary air which generated it. That makes it possible to optimize the deposition efficiency and robustness of the impacts of coating product on the objects being coated.

The meeting point 46 lies an axial distance $L_{46}$ of between once and twice the longest dimension of the primary 4 or secondary 6 orifices away from the common plane $P_{46}$. This longest dimension is considered in the common plane $P_{46}$. In this particular instance, it can either be the diameter $d_4$ or the diameter $d_6$, with no particular preference, because the primary 4 and secondary 6 orifices all have the same diameter. In practice, the axial distance $L_{46}$ between the meeting point 46 and the common plane $P_{46}$ is between 0.5 times and 30 times this longest dimension.

Such an axial distance $L_{46}$ makes it possible to achieve a relatively uniform summation of the flows of the jet of primary air $J_4$ and of the jet of secondary air $J_6$, hence limiting the unevennesses of the combined jet $J_{46}$ at and downstream of the edge 12.

As FIG. 6 shows, each combined jet $J_{46}$ has, in the plane of the edge 12, a cross section which is roughly in the shape of an ellipse $E_{46}$ truncated by the edge 12. The flow of the summed jet or of the combined jet $J_{46}$ is in fact deviated by the external rear surface 13 of the cup 1. The major axis $X_{46}$ of the ellipse $E_{46}$ is inclined at an angle $A_{46}$ with respect to a direction $T_{12}$ locally tangential to the edge 12. The angle $A_{46}$ is also determined by the respective orientations of each primary direction $X_4$ and of each secondary direction $X_6$, and by the respective positions of each primary orifice 4 and of each secondary orifice 6.

In this instance, the angle $A_{46}$ equals 50°. In practice, the angle $A_{46}$ may be between 20° and 70°, preferably between 35° and 55°. This inclination of the ellipse $E_{46}$, and therefore the combined jet $J_{46}$, makes it possible for the air speeds in the flows of combined jets $J_{46}$ flowing around the edge 12 to be rendered uniform, as described hereinafter in conjunction with FIGS. 7 and 8.

As FIGS. 7 and 8 show, the primary orifices 4 and the secondary orifices 6 are respectively positioned on the primary contour $C_4$ and on the secondary contour $C_6$, that is to say, in this instance, on the circle C, so as partly to mix two adjacent combined jets $J_{46}$. Thus, each lateral region of one combined jet $J_{46}$, considered in the direction $T_{12}$ defined by a tangent to the edge 12, mixes with a lateral region of the adjacent combined jet $J_{46}$. The mixing volumes $F_{46}$ are depicted by their section which is hatched in FIG. 8.

Such mixing makes it possible to ensure relatively good uniformity of the air speeds at the periphery of the edge 12, not only when considering a speed profile in the circumferential direction $T_{12}$ but also when considering a speed profile in a radial direction $R_{12}$.

In other words, the respective positions of the primary 4 and secondary 6 orifices, and the respective orientations of the primary $X_4$ and secondary $X_6$ directions, make it possible to achieve an isotropic field of air speeds all around the cup 1. As a result, the flow rates of air passing through two elementary sections of identical surface area but of arbitrary position within the envelope formed by the juxtaposition of the combined jets $J_{46}$ can be substantially the same. All the droplets atomized by the edge 12 are thus subjected to uniform and constant aerodynamic forces.

The effect of this is, firstly, that it gives the impacts of coating product on the object being coated a great deal of robustness and, secondly, that it appreciably improves the deposition efficiency, or transfer efficiency, with which the coating product is transferred to or deposited on the object being coated. Specifically, the uniform and constant aerodynamic forces make it possible to reduce the amount of coating product not deposited on the object being coated and generally known as "overspray".

It has been found, under various test conditions, that an increase in deposition efficiency of about 10% can be achieved. The deposition efficiency thus increases from around 75% for a rotary spray device of the prior art to around 87% for a rotary spray device according to the invention. For an installation that sprays coating product according to the invention and comprising a rotary spray device according to the invention, such deposition efficiency represents considerable savings in terms of the coating product to be sprayed and in terms of the waste products that have to be reprocessed.

The rotary spray device P can be implemented using a method of spraying coating product according to the invention. Advantageously, the flow rate of the primary air jets $J_4$ and the flow rate of the secondary air jets $J_6$ respectively represent 33% and 67% of the total air flow rate, which may range between 100 Nl/min and 1000 Nl/min, preferably between 300 Nl/min and 800 Nl/min. In practice, the flow rate of the primary air jets $J_4$ may represent 25% to 75% of the total air flow rate and the flow rate of secondary air $J_6$ may, to complement this, represent between 75% and 25% thereof. Such operating conditions and, in particular, such a distribution of the flow rates from the primary air jets $J_4$ and secondary jets $J_6$ makes it possible to optimize the deposition efficiency and robustness of the impacts of the coating product on the object being coated.

According to an alternative form that has not been depicted, the primary and secondary contours may be positioned in two separate planes. In particular, the primary and secondary contours may be positioned in two separate planes on a roughly frustoconical surface which extends in the downstream part of the fixed body and around the axis of rotation of the cup. More generally, the primary and/or the secondary contour may be non-planar.

According to another alternative form which has not been depicted, the fixed body of the rotary spray device may comprise additional orifices intended to emit air jets oriented differently from the primary and secondary air jets. Moreover, the fixed body may comprise additional orifices which are positioned differently from the primary and secondary orifices. Such additional orifices are not necessarily configured to produce combined jets, but may perform other functions.

The invention claimed is:

1. A rotary spray device for coating product, comprising:

a coating product spray member having at least one roughly circular edge and able to form a jet of coating product, means for driving the rotation of the spray member, and a body which is fixed and which comprises:

primary orifices arranged on a primary contour surrounding the axis of rotation of the spray member, each primary orifice being intended to eject a jet of primary air in a primary direction, secondary orifices arranged on a secondary contour surrounding the axis of rotation of the spray member, each secondary orifice being intended to eject a jet of secondary air in a secondary direction, wherein the respective orientations of each primary direction and of each secondary direction and the respective positions of each primary orifice and of each secondary orifice cause the formation of combined jets each resulting from the intersection of at least one jet of primary air and at least one jet of secondary air which are associated with one another, the region of intersection lying upstream of the edge.

2. The rotary spray device as claimed in claim 1, wherein each primary direction and the spray member are separate and wherein each secondary direction is secant to the spray member.

3. The rotary spray device as claimed in claim 2, wherein each secondary direction extends in a plane containing the axis of rotation, and wherein the secondary directions roughly converge toward a vertex lying on the axis of rotation.

4. The rotary spray device as claimed in claim 1, wherein each primary orifice and the associated secondary orifice are separated by a distance of between 0 mm and 10 mm.

5. The rotary spray device as claimed in claim 1, wherein the primary orifices and the secondary orifices are respectively positioned on the primary contour and on the secondary contour so as to cause two adjacent combined jets to mix partially.

6. The rotary spray device as claimed in claim 1, wherein all of the primary directions and all of the secondary directions respectively display symmetry with respect to the axis of rotation.

7. The rotary spray device as claimed in claim 1, wherein the distance between the primary contour and the edge, considered along the axis of rotation, is between 5 mm and 30 mm, and wherein the distance between the secondary contour and the edge, considered along the axis of rotation, is between 5 mm and 30 mm.

8. The rotary spray device as claimed in claim 1, wherein the primary contour and the secondary contour are each of circular shape.

9. The rotary spray device as claimed in claim 1, wherein the primary contour and the secondary contour are located in a common plane, the common plane being perpendicular to the axis of rotation.

10. The rotary spray device as claimed in claim 1, wherein the primary contour and the secondary contour are located on a roughly frustoconical surface which extends in a downstream part of the fixed body and around the axis of rotation of the spray member.

11. The rotary spray device as claimed in claim 8, wherein the primary contour and the secondary contour coincide in a circle centered on the axis of rotation, the ratio between the diameter of the edge and the diameter of the circle being between 0.65 and 1.

12. The rotary spray device as claimed in claim 11, wherein the body comprises between 20 and 60 primary orifices and between 20 and 60 secondary orifices, wherein the primary orifices and the secondary orifices are circular, wherein the primary orifices are arranged on the circle such that they alternate with the secondary orifices, and wherein the diameter of the primary orifices and the diameter of the secondary orifices range between 0.4 mm and 1.2 mm.

13. The rotary spray device as claimed in claim 9, wherein the intersection of the at least one jet of primary air and at least one jet of secondary air a meet at a meeting point, the distance along the axis of rotation between the common plane and the meeting point ranging between 0.5 times and 30 times.

14. The rotary spray device as claimed in claim 1, wherein each combined jet has a cross section in a plane of the edge which is roughly in the shape of an ellipse truncated by the edge, the major axis of the ellipse being inclined with respect to a direction locally tangential to the edge by an angle of between 20° and 70°.

15. The rotary spray device as claimed in claim 2, wherein the primary directions pass at a radial distance of between 0 mm and 25 mm from the edge, and wherein the secondary directions intersect the spray member at an axial distance of between 0 mm and 25 mm from the edge.

16. The rotary spray device as claimed in claim 4, wherein each primary orifice and the associated secondary orifice are separated by a distance of about 1 mm.

17. The rotary spray device as claimed in claim 11, wherein the primary contour and the secondary contour coincide in a circle centered on the axis of rotation, the ratio between the diameter of the edge and the diameter of the circle being approximately equal to 0.95.

18. The rotary spray device as claimed in claim 12, wherein the diameter of the primary orifices and the diameter of the secondary orifices are approximately equal to 0.8 mm.

19. The rotary spray device as claimed in claim 13, wherein the distance along the axis of rotation between the common plane and the meeting point ranges between once and twice, the longest dimension of the primary or secondary orifices considered in the common plane.

20. The rotary spray device as claimed in claim 14, wherein the major axis of the ellipse being inclined with respect to a direction locally tangential to the edge by an angle of between 35° and 55°.

21. The rotary spray device as claimed in claim 15, wherein the primary directions pass at a radial distance of 0 mm from the edge and the secondary directions intersect the spray member at an axial distance of approximately 3.5 mm from the edge.

22. A method of spraying a coating product comprising providing a rotary spray device with a total air flow rate of between 100 Nl/min and 1000 Nl/min, wherein the rotary spray device comprises a coating product spray member having at least one roughly circular edge and able to form a jet of coating product, a device for driving the rotation of the spray member, and a body which is fixed and comprises primary orifices arranged on a primary contour surrounding the axis of rotation of the spray member, each primary orifice being intended to eject a jet of primary air in a primary direction, secondary orifices arranged on a secondary contour surrounding the axis of rotation of the spray member, each secondary orifice being intended to eject a jet of secondary air in the secondary direction, wherein the respective orientations of each primary direction and of each secondary direction and the respective positions of each primary orifice and of each secondary orifice cause the formation of combined jets each resulting from the intersection of at least one jet of primary air and at least one jet of secondary air which are associated with one another, the region of intersection lying upstream of the edge, and wherein a flow rate associated with the jets of primary air is between 25% to 75% of the total air flow rate and a flow rate associated with the jets of secondary air is between 75% to 25% of the total air flow rate.

23. The method of claim 22, wherein the flow rate associated with the jets of primary air is approximately 33% of the total air flow rate and the flow rate associated with the jets of the secondary air is approximately 67% of the total air flow rate.

24. The method of claim 22, wherein the total air flow rate is between 300 Nl/min and 800 Nl/min.

25. A rotary spray device for coating product, comprising:

a coating product spray member having at least one roughly circular edge, wherein the coating product spray member is configured to form a jet for coating the product, a device for driving the rotation of the spray member, and a body which is fixed and which comprises a plurality of first orifices arranged on a primary contour surrounding an axis of rotation of the spray member, each of the first orifices is configured to eject a jet of air in a primary direction, and a plurality of second orifices arranged on a secondary contour surrounding the axis of rotation of the spray member, each of the second orifices is configured to eject air in a secondary direction different from the primary direction, wherein the plurality of first orifices extend in a direction oblique to the axis of rotation of the spray member and the plurality of second orifices extend in a direction transverse to the axis of rotation of the spray member, wherein the plurality of first orifices and the plurality of second orifices are alternately arranged such that one first orifice is between two second orifices, and wherein an adjacent pair of one first orifice and one second orifice are configured such that the jet of air associated with the one first orifice overlaps the jet of air associated with the one second orifice at a region upstream from the edge of the spray member.

26. The rotary spray device as claimed in claim 25, wherein the jet of air associated with the one first orifice is flowed at a first pressure and the jet of air associated with the one second orifice is flowed at a second pressure different from the first.

* * * * *